United States Patent [19]

Brodie

[11] 4,417,563

[45] Nov. 29, 1983

[54] IGNITION SYSTEM FOR INTERNAL COMBUSTION ENGINE

[76] Inventor: Durvis W. Brodie, 225 West 1st Street, Winkelman, Ariz. 85292

[21] Appl. No.: 293,227

[22] Filed: Aug. 17, 1981

[51] Int. Cl.[3] ..... H05B 37/02; H05B 39/04

[52] U.S. Cl. ..... 123/606; 123/607; 123/628

[58] Field of Search ..... 123/606, 607, 628

[56] References Cited

U.S. PATENT DOCUMENTS

| | | | |
|---|---|---|---|
| 1,968,930 | 8/1934 | Cotter et al. | 123/607 |
| 2,984,766 | 5/1961 | Moore | 123/607 |
| 3,019,782 | 2/1962 | Kuritza | 123/607 |
| 3,408,536 | 10/1968 | Tibbs | 123/607 |
| 3,502,060 | 3/1970 | Tibbs | 123/607 |
| 3,504,231 | 3/1970 | Tibbs | 123/607 |

*Primary Examiner*—Raymond A. Nelli

*Attorney, Agent, or Firm*—Drummond & Nissle

[57] ABSTRACT

An ignition system for an automotive internal combustion engine. The ignition system includes apparatus which is electrically interposed between the battery and the distributor to receive and transform current from the battery to ignition spark potential of sufficient magnitude to initiate an arc across the sparking gap of the engine spark plugs. The apparatus delivers a continuous flow of ignition spark potential to the distributor during operation of the internal combustion engine.

4 Claims, 3 Drawing Figures

IGNITION SYSTEM FOR INTERNAL COMBUSTION ENGINE

This invention relates to an internal combustion engine ignition system.

More particularly, the invention relates to an ignition system for an internal combustion engine of the type including a distributor for intermittently applying ignition spark potential to each of the spark plugs in timed relationship with the engine crank shaft in order to ignite combustible fuel-air charges in the cylinders of the engine.

In another respect the invention pertains to an internal combustion engine ignition system of the type described which delivers a continuous flow of ignition spark potential to the distributor during operation of the engine.

In a further respect the invention pertains to an internal combustion engine ignition system which eliminates the ignition coil, condenser, distributor vacuum control apparatus, and distributor centrifugal weights which are normally associated with the ignition system of an internal combustion engine.

In still another respect, the invention pertains to an internal combustion engine ignition system which, in comparison to a conventional ignition system including an ignition coil, condenser, distributor vacuum control, etc., markedly increases both the life of the engine spark plugs and the efficiency of operation of the internal combustion engine.

During operation of a conventional automotive internal combustion engine, combustible fuel-air mixture injected into each of the cylinders of the engine is ignited by a spark jumping across the gap between the electrodes of a spark plug. The spark is caused by high voltage produced and intermittently directed into the spark plug by associated elements of the ignition system. As is well known, the ignition system ordinarily includes an ignition coil, a contact-breaker or "points," a condenser, distributor, vacuum control unit for the distributor, and centrifugal weight control for the distributor. In operation the ignition system alternately causes current to travel first through the primary winding of the ignition coil and through the points and then, when the points open and the magnetic field generated by current traveling through the primary winding breaks down, causes current to travel through the secondary winding of the ignition coil to the distributor and to one of the spark plugs. In other words, conventional ignition systems effectively commutate the direction of current flow back and forth between the distributor and the points.

Although conventional ignition systems including an ignition coil and points have proven to be highly reliable, the commutation of current effected by the interaction of the ignition coil and breaker points necessitates the periodic replacement of elements such as the points and condenser which are subjected to continual sparking while the internal combustion engine is operating.

Many systems have been proposed for simplifying or improving the performance of automotive ignition systems. See for example, U.S. Pat. Nos. 3,892,219 to Preiser; 4,043,302 to Sessions; 4,117,819 to Jarrett and 4,183,340 to Gilbert. Such prior art systems are, technically speaking, relatively complicated and can only be installed on existing automobile engines by technicians having considerable electronic and mechanical background and, by performing time consuming modifications on the engine.

Accordingly, it would be highly desirable to provide an improved internal combustion engine ignition system which would eliminate the ignition coil, condenser, contact points, distributor vacuum control unit and distributor centrifugal weight control associated with conventional ignition systems.

It would also be highly desirable to provide an improved internal combustion engine ignition system which could be readily and conveniently installed in an existing automobile engine by persons of limited mechanical skill using conventional, simple hand tools.

Therefore, it is the principal object of the invention to provide an improved ignition system for an automotive internal combustion engine.

Another object of the invention is to provide an ignition system for an internal combustion engine which would eliminate the ignition coil, points, condenser and distributor vacuum control unit currently found in conventional ignition systems.

A further object of the invention is to provide an improved internal combustion engine ignition system which would eliminate the commutation of current effected by the ignition coil and points of prior art automotive ignition systems and would instead deliver a continuous flow of current to the distributor during operation of the internal combustion engine.

Still another object of the instant invention is to provide an improved ignition system which could be simply and readily installed on existing internal combustion engines by relatively unskilled persons using only simple, conventional hand tools.

Yet another object of the invention is to provide an improved ignition system which would increase the life of engine spark plugs and permit more thorough and efficient combustion of fuel during operation of the engine.

These and other, further and more specific objects and advantages of the invention will be apparent to those skilled in the art from the following detailed description thereof, taken in conjunction with the drawings, in which.

Briefly, in accordance with the invention, I provide an improved ignition system for an internal combustion engine. The engine includes a housing; at least a pair of combustion chambers formed in the housing; passage means formed in the housing for communicating a combustible mixture to the combustion chambers and to transport exhaust gases therefrom; spark plugs carried by the housing for intermittently igniting the combustible mixture in the combustion chambers; a distributor for accepting and intermittently applying ignition spark potential to each of the spark plugs in timed relationship with the engine; and a source of current potential. The improved ignition system comprises means electrically interposed between the current source and the distributor for receiving and transforming current from the current source to ignition spark potential of sufficient magnitude to initiate an arc across the spark gap of the spark plugs, said means delivering a continuous flow of ignition spark potential to the distributor during operation of the internal combustion engine.

Figure 1:
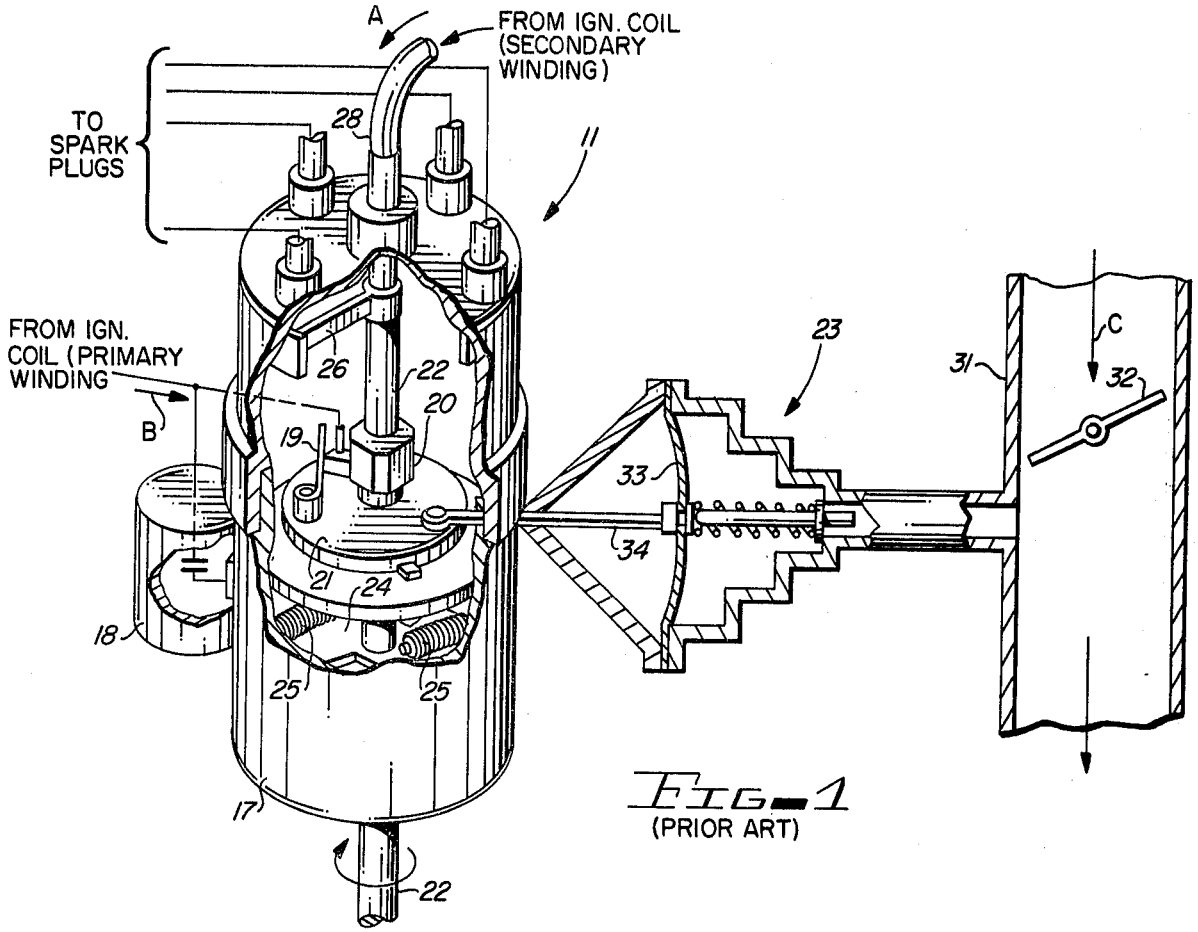
FIG. 1 (PRIOR ART)
FIG. 1 is a combination perspective-sectional view of a conventional distributor and associated distributor vacuum control unit.
Figure 2:
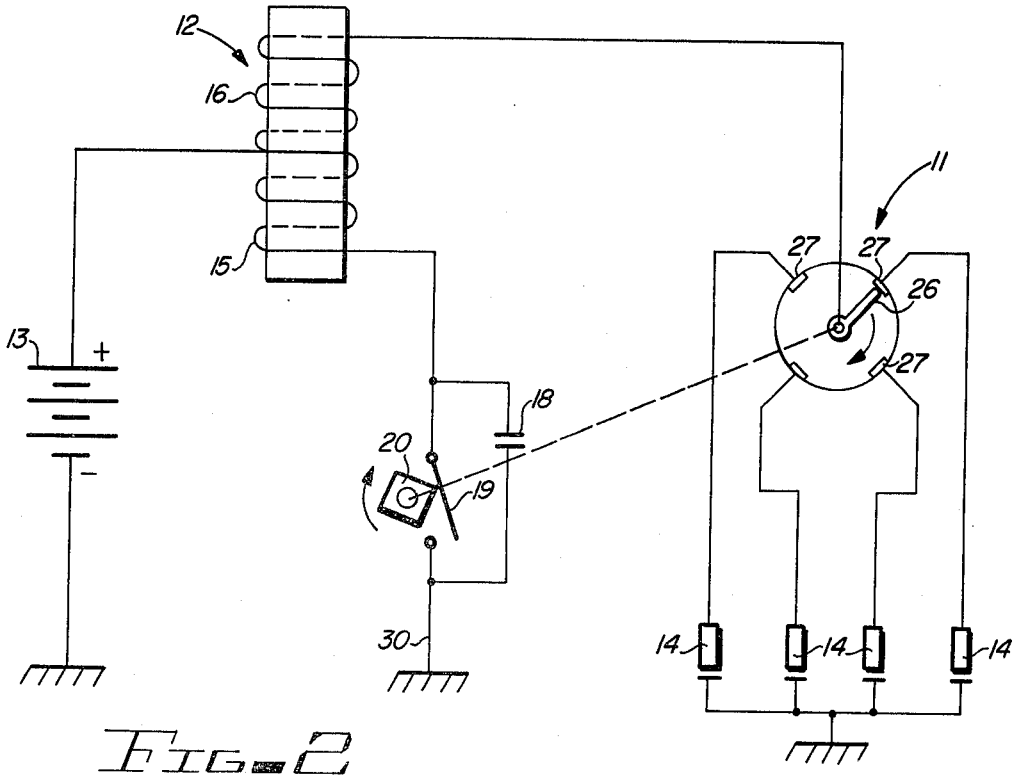
FIG. 2 (PRIOR ART)
FIG. 2 is a schematic view depicting a conventional ignition system for an internal combustion engine.

Turning now to the drawings, which depict the presently preferred embodiments of the invention for the purpose of illustrating the practice thereof and not by way of limitation of the scope of the invention and in which like reference characters illustrate corresponding elements throughout the several views, FIGS. 1 and 2 illustrate a conventional automotive ignition system including distributor 11, ignition coil 12, battery 13 and spark plugs 14. Ignition coil 12 includes primary winding 15 which is part of the secondary winding 16. Housing 17 of distributor 11 carries condenser 18 and vacuum timing adjustment unit 23 and encloses contact-breaker or "points" 19, contact-breaker cam 20, contact breaker plate 21, distributor shaft 22, centrifugal weights 24, springs 25, rotor 26 and contacts 27. Each electrode 27 is connected to a wire which leads to a spark plug 14 in one of the combustion chambers or cylinders (not shown) of the engine. Cam 20 and rotor 26 are carried by shaft 22. The lower end of shaft 22 is connected to a drive pinion in the engine block such that shaft 22 is rotated in synchronization with the drive shaft of the engine. Rotor 26 intermittently receives current (indicated by arrow A) through carbon brush 28 carried in the top of housing 17. When contact-breaker 19 is closed current (indicated by arrow B) from the primary winding 15 of coil 12 flows therethrough to ground.

Distributor 11 is constructed so that the outer tip of rotor 26 is always adjacent an electrode 27 when cam 20 opens contact-breaker 19 and interrupts the flow of current through primary winding 15 and points 19. At the instant points 19 open, the magnetic field which was formed by current flowing through primary winding 15 collapses and induces a high voltage in the secondary winding 16 of ignition coil 12, and this voltage passes through rotor 26 to the appropriate electrode 27 and associated sparking plug 14. While the ignition spark potential or voltage is being applied to a sparking plug 14, condenser 18 prevents the occurrence of sparking at the points 19. Thus, the ignition system of FIGS. 1 and 2 commutates current between a pair of electrical circuits; a primary circuit including the battery 13, primary winding 15 of coil 12, closed breaker-contacts 19 and ground 30; and, a secondary circuit including secondary winding 16 or coil 12, rotor 26, electrodes 27 and spark plugs 14.

The optimal ignition timing very largely depends upon and varies with the type of petrol and with the load and speed of the engine at any particular time. In order to be able to adjust the ignition timing, the distributor shaft 22 is comprised of two parts, an upper end and a lower end. The upper end is rotatable with respect to the lower end so that cam 20 can be rotated or adjusted relative to the drive transmitted through the lower section of shaft 22 from the engine cam or drive shaft. The upper end of shaft 22 is rotated with respect to the lower end of shaft 22 by centrifugal weights 24 when the weights are flung outwards by centrifugal force as the speed of the engine and, consequently, the speed of rotation of shaft 22 increases. Springs 25 exert an inward pull on weights 24 to counteract the centrifugal pull on weights 24. The effect of the rotation of the upper part of shaft 22 by weights 24 is to cause the ignition to take place earlier at high speeds than at low engine speeds.

An arm attached to the upper part of shaft 22 and having a pin engaging a slot in each centrifugal weight 24 is attached to the upper part of shaft 22 and forms the connection between weights 22 and the upper part of shaft 22. When weights 24 move outwardly the slots formed therein cause the pin and arm and, consequently, the upper portion of shaft 22 to rotate in relation to the lower end of shaft 22. As a result, cam 20 is also rotated with respect to the lower end of shaft 22 and the instant at which contacts 19 open in relation to the position of the engine crankshaft is altered.

Additional adjustment of distributor 11 can be effected with vacuum control unit 23 which reacts to negative pressure in the air induction pipe 31 of the engine. Air is drawn into pipe 31 in the direction indicated by arrow C. As shown in FIG. 1, negative pressure which develops behind throttle valve 32 in induction pipe 31 draws diaphragm 33 away from distributor 11. One end of contact lever 34 is attached to diaphragm 33 while the other end is pivotally connected to plate 21 carrying points 19. When diaphragm 33 is displaced, lever 34 rotates plate 21 and alters the position of contact-breaker 19 in relation to cam 20. Vacuum control unit 23 has more effect when the throttle valve is not fully open, i.e., in the partial load range, whereas the ignition timing adjustment accomplished by the centrifugal weights 24 has greater impact at higher engine speeds.

The centrifugal weight 24 and vacuum 23 controls are utilized in part because the spark produced in each combustion cylinder of the engine is of relatively short duration, and since the optimal moment for the production of the spark varies with the speed and load of the engine, it is critical that the ignition spark occur at the optimal moment during the power or downstroke of the piston.

Figure 3:
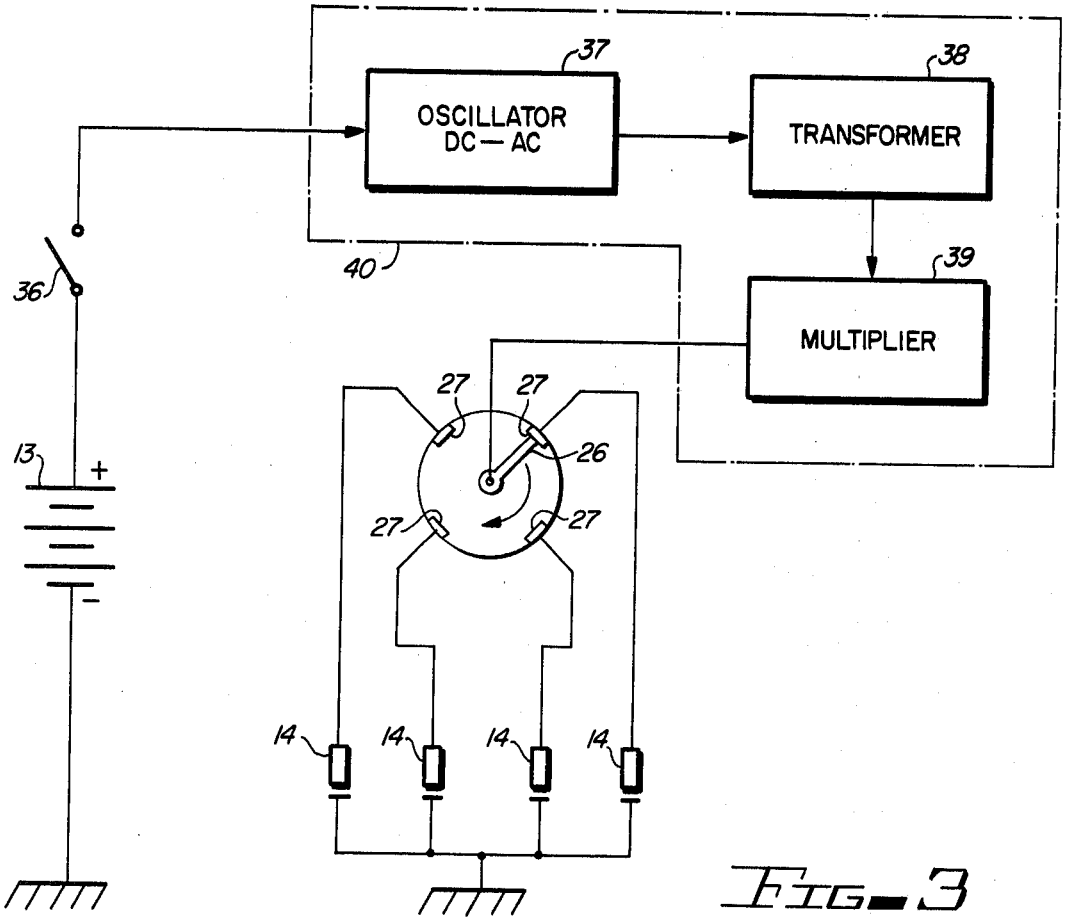
FIG. 3 is a schematic view illustrating an ignition system constructed in accordance with the principles of the invention.

As illustrated by FIG. 3, an ignition system constructed in accordance with the invention eliminates the ignition coil 15, points 19, condenser 18, vacuum control unit 23, centrifugal weights 24, and cam 20 found in conventional ignition systems. The presently preferred embodiment of the invention depicted in FIG. 3 includes battery 35, ignition switch 36, oscillator 37, transformer 38, diode-condenser multiplier 39 and distributor 11. In operation, direct current from battery 35 flows to oscillator 37 when ignition switch 36 of the automobile engine is closed. The oscillator produces a high frequency alternating current of 20–50 kilohertz. The high frequency signal produced by the oscillator permits a light weight ferrite coil transformer 38 to be utilized to step up the voltage to six or seven kilovolts. Current from transformer 38 is rectified and further stepped up to 14 to 28 kilovolts by a "doubler" or "tripler" 39 comprised of diode-condenser combinations. Voltage from the diode-condenser transformer 39 is continually supplied to distributor 11 such that whenever the outer tip of rotor 26 is adjacent a contact 27 current flows to the appropriate spark plug 14. Since current is continually flowing to distributor 11, each spark plug 14 produces a spark during the entire time the tip of rotor 26 is adjacent a contact 27 and a spark is provided in each cylinder of the engine during a substantial portion of the downstroke of the piston. Increasing the duration of the spark results in more complete combustion and eliminates the need for the centrifugal weight and vacuum controls of conventional ignition systems. A longer spark duration also reduces the rate of degeneration of the spark plug electrodes and minimizes fouling of the plug by pollutants and other contaminants which remain after incomplete combustion of the fuel-air charge in the cylinder.

A particular advantage of the invention is that it is readily installed on an existing automobile engine by simply disconnecting the wires leading from the ignition coil to the distributor and to the breaker points and condenser and by disconnecting springs 25 and the vacuum line leading from induction pipe 31 to vacuum unit 23. A container housing oscillator 37, transformer 38 and "doubler" 39 is then electrically interposed between battery 13 and distributor 11 of the engine ignition system. Since the ignition system apparatus of FIG. 3 provides a spark during substantially the entire downstroke of the piston, it is only necessary to insure that the spark is initiated at the proper time during the downstroke of the piston. This is accomplished by adjusting—usually retarding—the timing after installation of the ignition unit 40 of FIG. 3. As would be appreciated by those of skill in the art, unit 40 can be readily disconnected and transferred from automobile to automobile.

In adapting new cars to accept an ignition system constructed in accordance with the invention, it could be advantageous to replace the conventional mechanically actuated distributor 11 with an electronic distributor which would electronically or electrically activate a four-way switch (for a four cylinder engine) accepting ignition spark potential from unit 40. The electronic switch would alternately direct current to each spark plug 14 for a pre-selected length of time and could be controlled by a sensor which monitored the rotation of the crank shaft or movement of another appropriate element of the internal combustion engine. An electronic distributor and a conventional distributor would, of course, both perform the identical function of accepting and intermittently applying ignition spark potential to each of the spark plugs in timed relationship with other moving parts of the engine.

Current fed into oscillator 37 could be drawn from an alternator, generator or other current source and alternating current could be produced for distributor 11 by unit 40 instead of the direct current produced by the particular components illustrated in FIG. 3.

Having described my invention in such terms as to enable those skilled in the art to understand and practice it, and having identified the presently preferred embodiments thereof, I claim:

1. In combination with an internal combustion engine including a housing, at least a pair of combustion chambers formed in said housing, passage means formed in said housing for communicating a combustible mixture to said combustion chambers and for transporting exhaust gases therefrom, spark plugs carried by said housing for intermittently igniting said combustible mixture in said combustion chambers, a distributor for accepting and intermittently applying ignition spark potential to each of said spark plugs in timed relationship with said engine, and a low voltage source of direct current, ignition system means electrically interposed between said direct current source and said distributor for receiving and transforming current from said current source to ignition spark potential of sufficient magnitude to initiate an arc across the spark gap of said spark plugs, said ignition system means delivering a continuous flow of ignition spark potential to said distributor during operation of said internal combustion engine and including (a) oscillator means for receiving current from said source of direct current potential and producing a low voltage high frequency alternating current signal;

(b) transformer means for receiving said low voltage high frequency current signal produced by said oscillator means and stepping up the voltage thereof; and (c) means for receiving said stepped up voltage signal produced by said transformer and rectifying said signal, said rectified signal being continuously applied to said distributor during operation of said internal combustion engine.

2. The internal combustion engine of claim 1 wherein said signal produced by said oscillator means has a current frequency in the range of twenty to fifty kilohertz.

3. The internal combustion engine of claim 2 wherein said transformer means produces a signal having voltage in the range of six to seven kilovolts.

4. A method for modifying an internal combustion engine including a housing, at least a pair of combustion chambers formed in said housing, passage means formed in said housing for communicating a combustible mixture to said combustion chambers and for transporting exhaust gases therefrom, spark plugs carried by said housing for intermittently igniting said combustible mixture in said combustion chambers, an ignition system including a battery, an ignition coil electrically connected to said battery and having a primary winding and a secondary winding, a condensor electrically connected to said primary winding of said ignition coil, a distributor having electrical contacts and a rotor electrically connected to said secondary winding of said ignition coil, each of said contacts being electrically connected to one of said spark plugs, said rotor intermittently receiving current from said ignition coil and permitting said current to flow to said contacts and said spark plugs during operation of said internal combustion engine, and, contact-breaker means operatively associated with said distributor and electrically connected to said primary winding of said ignition coil, said contact-breaker means periodically interrupting the flow of current through said primary coil to induce a high voltage in said secondary coil, said high voltage passing through said rotor of said distributor to one of said contacts and said spark plug associated therewith, said method comprising the steps of (a) obtaining ignition system means including (i) oscillator means for receiving current from said battery and producing a high frequency alternating current signal, (ii) transformer means for receiving said low voltage high frequency current signal produced by said oscillator means and stepping up the voltage thereof, and (iii) means for receiving said stepped up voltage signal produced by said transformer and rectifying said signal, said rectified signal being continuously produced during operation of said internal combustion engine;

(b) disconnecting said ignition coil from said battery;

(c) disconnectng said secondary winding of said ignition coil from said distributor rotor; and (d) electrically interposing said ignition system means between said battery and said distribution rotor such that said oscillator means receives current from said battery and said rectifying means continuously applies said rectified signal to said distributor rotor during operation of said internal combustion engine.

* * * * *